US007137721B1

(12) United States Patent
Rao et al.

(10) Patent No.: US 7,137,721 B1
(45) Date of Patent: Nov. 21, 2006

(54) WEATHERPROOF OUTDOOR PIVOTING LIGHT ASSEMBLY

(76) Inventors: C. Gireesh Rao, 202-V Foliage Cir., Cary, NC (US) 27511; Ashok Sathyanarayana Alilughatta, D-703 Spring Field Society, Kothrud Pune 411 029 (IN); Tushar Han Godbole, C-701 Rajyog Housing Society, Sangamnagar, Bibewadi Pune 411 037 (IN)

( * ) Notice: Subject to any disclaimer, the term of this patent is extended or adjusted under 35 U.S.C. 154(b) by 13 days.

(21) Appl. No.: 10/865,820

(22) Filed: Jun. 14, 2004

(51) Int. Cl.
*F21V 21/30* (2006.01)
*F21V 31/00* (2006.01)

(52) U.S. Cl. ..... 362/371; 362/267; 362/310; 362/427; 362/430; 362/645

(58) Field of Classification Search ..... 362/371, 362/267, 645, 310, 427, 429, 430; 174/64, 174/65
See application file for complete search history.

(56) References Cited

U.S. PATENT DOCUMENTS

| | | | | |
|---|---|---|---|---|
| 2,699,491 | A * | 1/1955 | Sternaman | 362/267 |
| 2,910,577 | A * | 10/1959 | Bolmeyer | 362/267 |
| 3,104,064 | A * | 9/1963 | Bellek | 362/267 |
| 4,259,710 | A * | 3/1981 | Schlack | 362/267 |
| 4,660,916 | A * | 4/1987 | Williams, Jr. | 439/271 |
| 5,280,417 | A * | 1/1994 | Hall et al. | 362/640 |
| 5,386,356 | A * | 1/1995 | Davis et al. | 362/267 |
| 5,667,296 | A * | 9/1997 | Cheng et al. | 362/267 |
| 6,758,578 | B1 * | 7/2004 | Chou | 362/647 |

FOREIGN PATENT DOCUMENTS

JP 06290608 A * 10/1994

* cited by examiner

*Primary Examiner*—Alan Cariaso
(74) *Attorney, Agent, or Firm*—Mills Law Firm PLLC

(57) ABSTRACT

A weatherproof outdoor pivoting light assembly includes a front gasket on a metallic lamp housing having spaced sealing rings for locally compressively engaging to seal the floodlight envelope and a rear gasket for sealing the power cord thereby providing a sealed cartridge for the electrical socket enabling mounting at ground and structure location.

10 Claims, 9 Drawing Sheets

WEATHERPROOF OUTDOOR PIVOTING LIGHT ASSEMBLY

FIELD OF THE INVENTION

The present invention relates to outdoor lighting apparatus, and, in particular, to weatherproofing of out door light assemblies.

BACKGROUND OF THE INVENTION

Pivoting light assemblies are commonly used for outdoor lighting where varying inclinations of the light source are desired to produce directional or aesthetic effects. One highly popular pivoting light assembly uses a line voltage floodlight, such as parabolic aluminized reflector units designated PAR 30 or PAR 38 lamps. The floodlight is connected to a surface or ground mounted brackets at a pivotal connection that allows user to direct the illumination at select inclinations.

The outdoor location presents severe operating conditions. Moisture in the form of rain and snow can enter the lamp housing causing electrical and potential safety problems. The prevalent entry paths are at the between the light and the housing and at the rear along the power cord port. Accordingly, use in wet locations and inclined inclination in raised positions are not recommended. Moreover, dirt and grime can enter the unit and corrode the bulb connections, making removal the lamp difficult, possibly resulting in fracture of the glass envelope. Further, receiving desired approvals for the desired outdoor uses, particularly units having metallic housings mounted on walls, from recognized sources such Underwriters Laboratories is not possible unless the unit is completely weatherproofed.

While various sealing arrangements have been proposed for the wide range of light assemblies, none adequately addresses the particular needs of the outdoor pivoting light assemblies using the PAR lamp configurations. For instance, U.S. Pat. Nos. 5,667,296 and 5,718,504 disclose outdoor Christmas lights having gaskets for sealing the bulbs. The gaskets have chamfered inner surfaces having substantial surface engage the bulb envelopes. While effective with smaller generally conical surfaces, the eccentricities in assembling the socket to the housing in outdoor PAR bulbs could create gaps in the sealing interface resulting in leakage and potential electrical shocks. Similar drawbacks could occur with the floodlight gasket disclosed U.S. Pat. No. 4,660,916 to Williams wherein a surface to surface contact is effected with the neck of the bulb. Moreover, during installation or removal of the bulb, substantial torque is developed at the sealing interface that can dislodge the gasket and create present or subsequent leakage paths. Additional leakage problems can occur at power cord. In plastic molded units, an effective cord seal may be obtained. For metal units, the normal clearance between the cord inlet hole and the cord can create leakage paths to the interior electrical connections, also posing potential safety risks.

BRIEF SUMMARY OF THE INVENTION

The present invention provides an improved outdoor pivoting light assembly with metallic housings using a front and rear gasket for sealing potential leakage paths. A front gasket is provided to seal between the housing and the bulb envelope. The front gasket has an interior front wall conforming to the neck of the envelope that includes a pair of axially spaced narrow sealing rings that locally compressively engage the neck to establish sealing interfaces providing primary and secondary barriers to moisture penetration. The rings offer minimal resistive torque to insertion or removal of the bulb thereby maintaining the operative position of the front gasket. Additionally, the front gasket may be provided with inwardly projecting barbs are inserted into mating holes on the housing to further maintain the front gasket in place. A rear gasket is provided to seal between the cord inlet hole and the power cord. The rear gasket is a cylindrical sleeve received over the power cord, inserted into the cord hole, and retained at grooved connection. The gaskets effect a secure sealed cartridge for light components resistant to outdoor moisture conditions allowing the light assembly to be mounted on structure surfaces at desired angles of inclination for achieving a desired lighting effect.

DESCRIPTION OF THE DRAWINGS

The above and other advantages and features of the invention will become apparent upon reading the following description taken in conjunction with the accompanying drawings in which.

DETAILED DESCRIPTION OF THE PREFERRED EMBODIMENTS

Figure 1:
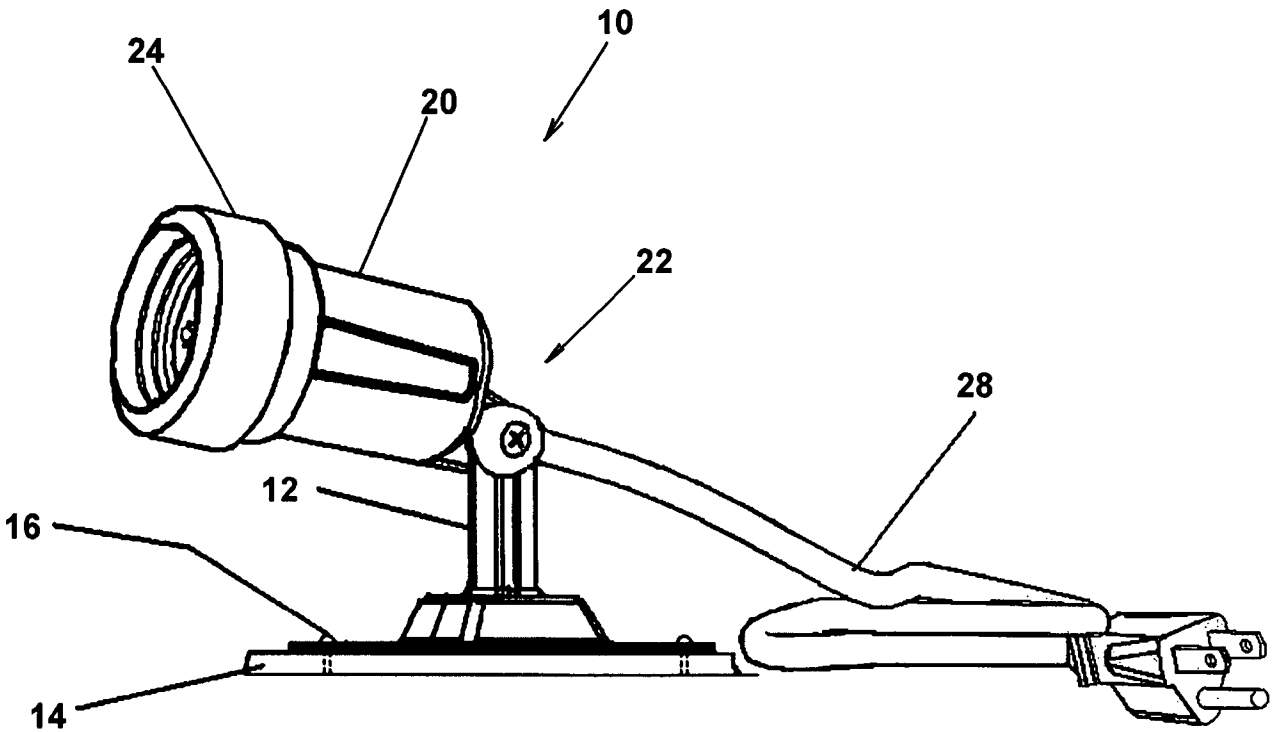
FIG. 1 is a perspective view of the weatherproof outdoor pivoting light assembly provided with mounting base for surface installation and provided with a sealing assembly according to an embodiment of the invention.

Referring to the drawings for the purpose of describing the preferred embodiment and not for limiting same, FIG. 1 illustrates a weatherproof outdoor light assembly 10 adapted for conventional pivotal horizontal or vertical mounting at a surface bracket 12 to a surface substrate 14 by fasteners 16. Alternatively, as shown in FIG. 2, the light assembly 10 may be mounted at a ground bracket or spike 18 for attachment to the ground 19.

The light assembly 10 as described below is adapted for carrying a low wattage or high intensity lamp, not shown in these figures. A suitable exemplary lamp is a PAR 38 line voltage lamps, and the invention will be described with reference thereto.

The light assembly 10 includes a light housing 20 interchangeably adjustably connected to the brackets 12, 14 at a pivotal connection 22. The housing 20 carries a front gasket 24 for engaging the light bulb and the housing to prevent ambient moisture and precipitation from frontally entering the housing interior, and a rear gasket 26 carried at the rear of the housing 20 and surrounding the light power cord 28 to prevent moisture and precipitation from rearwardly entering the housing interior, thereby providing a weatherproof unit for outdoor mounting at the angles of inclination accommodated by the pivotal connection 22.

Figure 2:
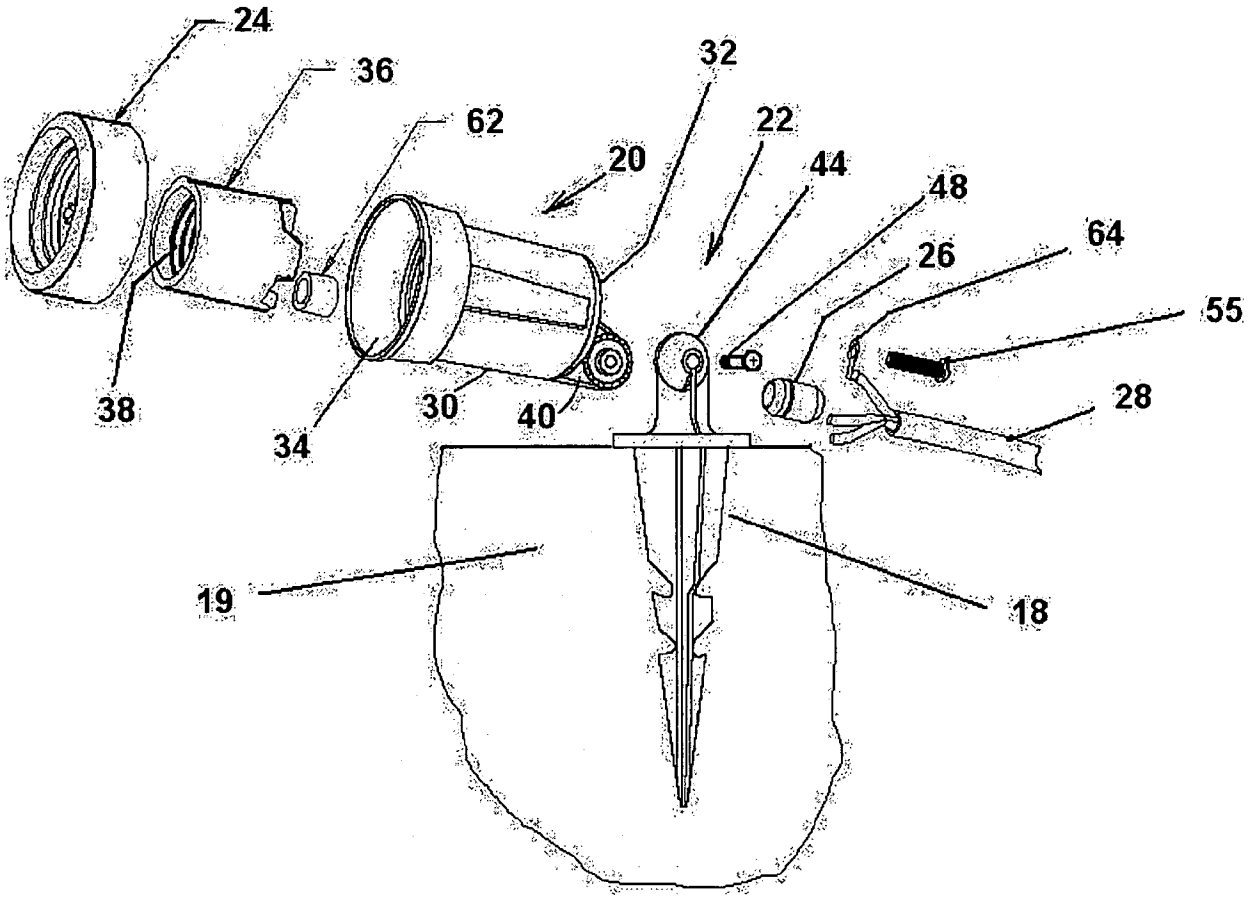
FIG. 2 is an exploded perspective view of the pivoting light assembly shown in FIG. 1 provided with a mounting spike for ground installation.

Referring to FIG. 2, the housing 20 is formed of a thin wall metal or plastic material and includes a peripheral side wall 30 and a base 32, the inner surfaces of which define a frontally opening cavity 34. As additionally shown in FIG. 6, a conventional porcelain socket 36 having a threaded contact sleeve 38 and a base contact 39 is operatively mounted in the cavity 34. The housing 20 includes a support arm 40 extending from the base 32. The arm 40 includes an end section provided with a threaded aperture and surrounded by annular band of radial teeth that mate with teeth on a corresponding band on the exposed leg 44 of the stake 18. A screw 48, or other suitable fastener, is threaded into the aperture and permits adjustment of the housing relative to the stake or bracket in a plurality of incremental inclinations, all in a well known manner.

Figure 3:
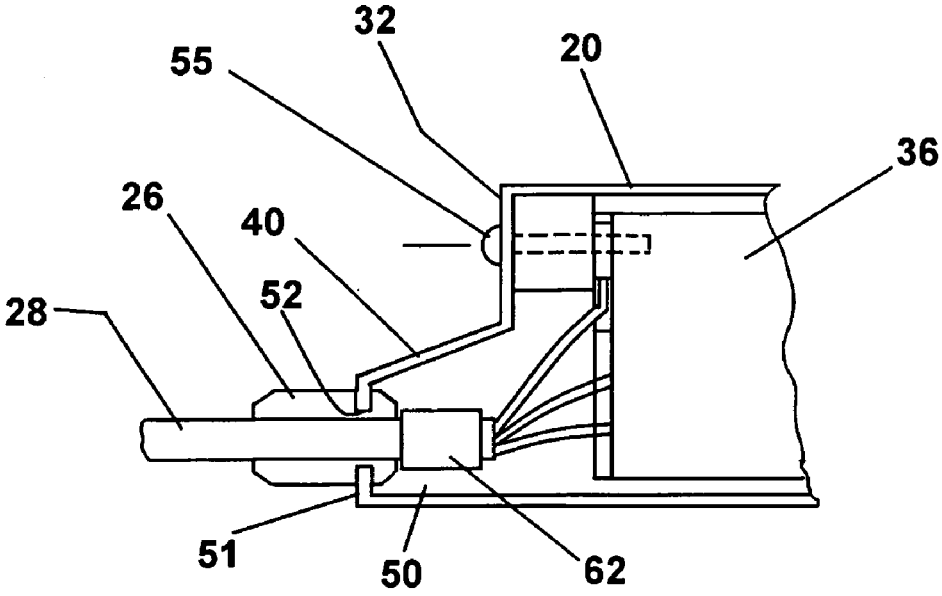
FIG. 3 is a vertical cross sectional view of the base of light housing illustrating the rear sealing gasket.

Referring to FIG. 3, the support arm 40 is a thin wall extension on the rear of the housing forming a pocket 50 opening frontally into the cavity 34. The rear wall 51 of the arm 40 includes a circular rear opening 52. The rear gasket 26 is mounted in the opening 52. Another opening is formed in the base 32 of the housing 20. As described in greater detail below, a fastener 55 is inserted through a threaded hole in the socket 36 for fixedly mounting the latter in assembly. In assembly production, the socket 36 may be limitedly eccentric to the housing. Nonetheless, as described below, the front gasket 24 accommodates the eccentricity and maintains weatherproof sealing relationships.

Figure 4:
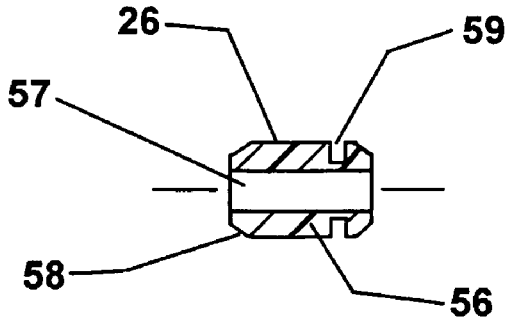
FIG. 4 is a cross sectional view of the rear sealing gasket.

Referring to FIG. 4, the rear gasket 26 is a one-piece elastomeric molding having an annular body 56 and a central axial bore 57. The body 56 is provided with frustoconical ends 58. An annular groove 59 is formed in the body having a base diameter slightly smaller than the opening on the rear wall 51 of the arm 44 and a width comparable to the thickness of the arm wall. The bore 57 has a diameter providing a light compressive fit with the power cord 28. For assembly as shown in FIG. 3, the rear gasket 26 is forwardly inserted into the hole and positioned with the with rear wall opening in the groove 59. The terminal end of the power cord 28 extends through the cord gasket 26 into the housing cavity.

Figure 5:
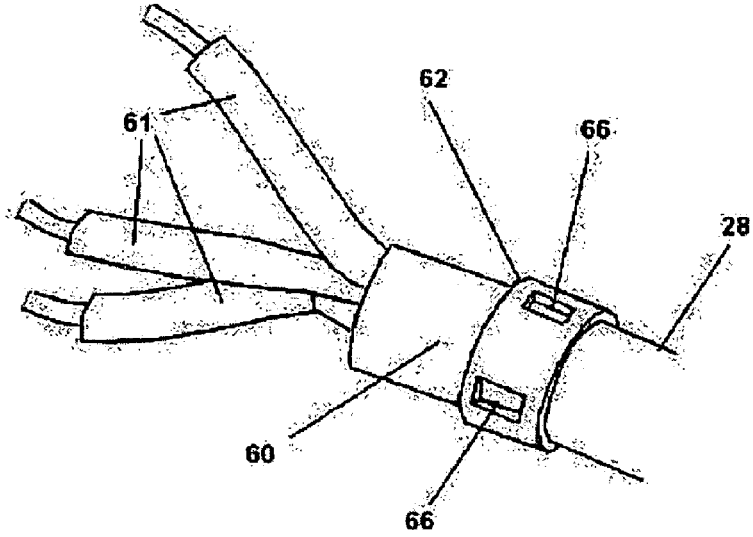
FIG. 5 is an enlarged perspective view of the end of the power cord.

Referring to FIG. 5, the power cord 28 is a conventional sheathed three wire cable. For assembly, the terminal end of the sheath 60 is removed and the insulation of the leads wires 61 stripped for enabling the electrical connection. The terminal end is inserted through the rear gasket 26 and outwardly of the housing. Thereafter, a crimp ring 62 of a deformable material is swaged at 66 onto the end of the sheath 60 to mechanically prevent withdrawal in the rear direction. Conventionally, the power cord 28 includes a ground lead and power leads extending sufficiently beyond the crimp ring 62 to allow conventional electrical connection at the socket 36. The power leads may be riveted to the connectors of the base contact and contact sleeve of the socket. As shown in FIG. 2, the ground lead includes a circular end terminal 64. After electrical connections are effected, the socket 36 is inserted into the housing cavity 34. The fastener 55 is inserted through the hole in the boss 54 and the eyelet of the terminal 64, and threaded into the socket, thereby fixedly mounting the socket in the housing and establishing the ground for the power cord 28. Accordingly, the fastener prevents forward movement of the socket and the crimp ring 62 rearward movement of the power cord, whereby loading on the electrical connections and lead wires is isolated. The rear gasket 26 completely seals the support arm opening and the cord, and the fastener head seals the opening in the rear wall, thereby providing water proofing barriers against rear moisture intrusion.

Figure 6:
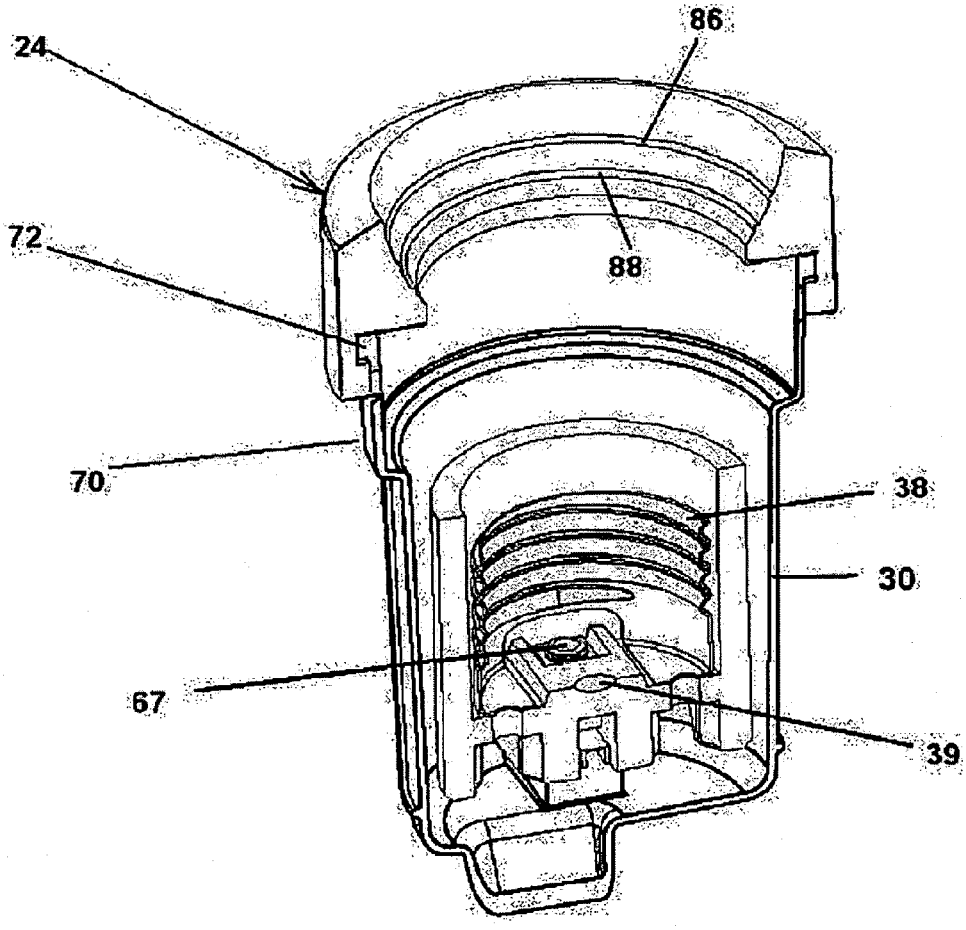
FIG. 6 is a vertical cross sectional view of the front gasket and the light housing.
Figure 7:
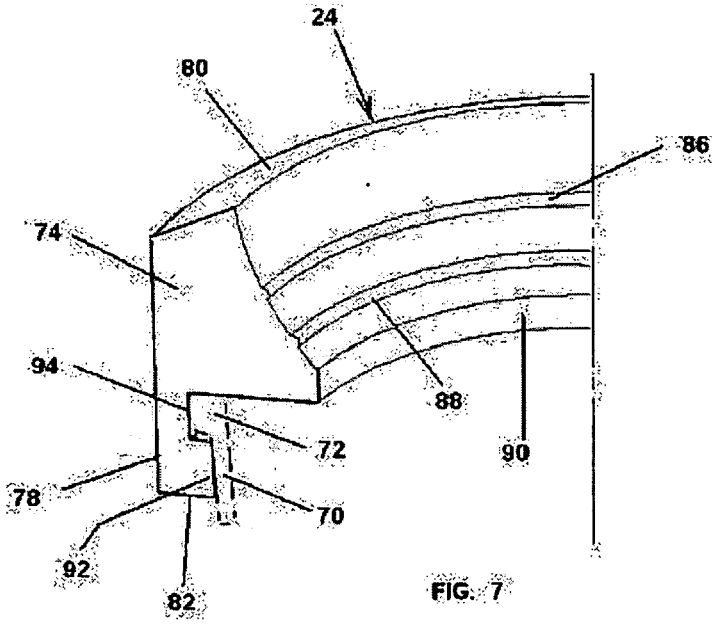
FIG. 7 is an enlarged fragmentary perspective view of the front gasket.

Referring to FIG. 6, the forward end of the side wall 22 of the housing 20 terminates with a shallow frustoconical sleeve 70 having an outwardly turned annular flange 72. The front gasket 24 is carried on the sleeve 70 and retained at the flange 72. Referring additionally to FIG. 7, the gasket 24 is a one piece molded annular elastomeric body 74 having an inner surface defining a central axial opening. The body 24 has a cylindrical outer wall 78, a frustoconical front wall 80 and an annular end wall 82. The inner surface includes a frontal curved wall 84 including annular axially spaced sealing ribs 86, 88, a cylindrical middle wall 90, and a cylindrical rear wall 92 axially spaced from the middle wall 90 by an annular groove 94. The flange 72 is received in the groove 94 with the base thereof having a compressive fit with the outer surface of the flange 72 to establish a sealing interface with the housing 20. The width of the groove 94 is slightly wider than the thickness of the flange to accommodate limited movement in assembly. The section of the body 24 has sufficient elasticity to accommodate eccentricities between the housing 20 and the associated lamp unit.

Figure 8:
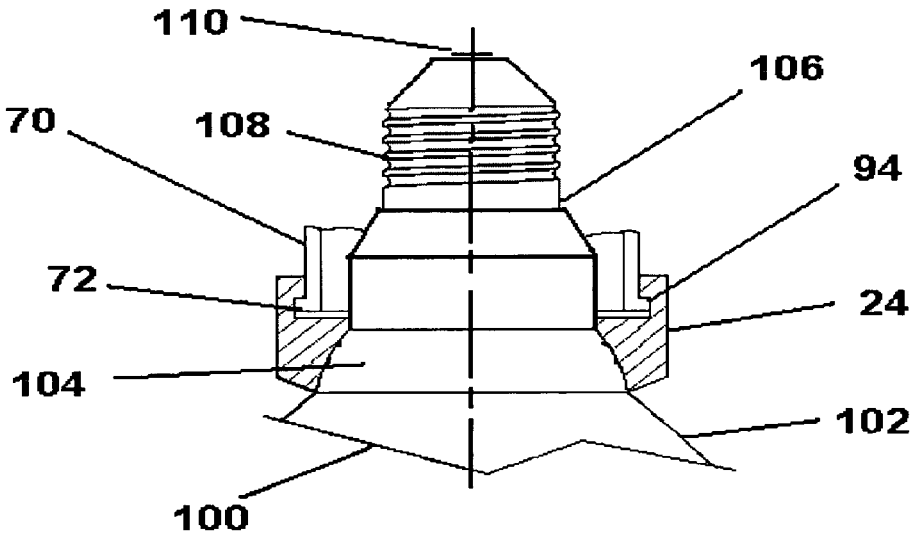
FIG. 8 is a cross sectional view of the light housing and the light source.
Figure 9:
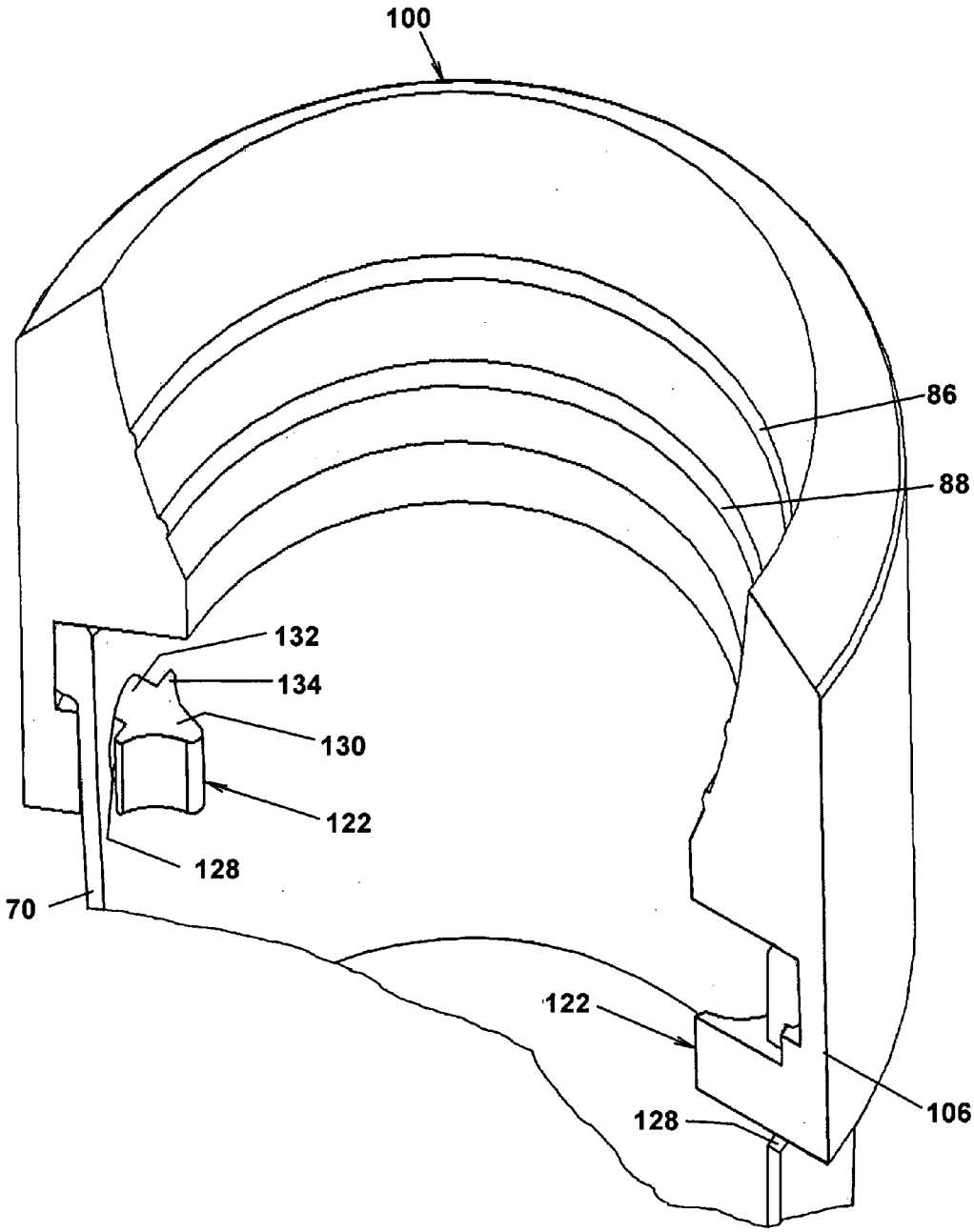
FIG. 9 is a vertically sectioned perspective view of another embodiment of the front gasket.
Figure 10:
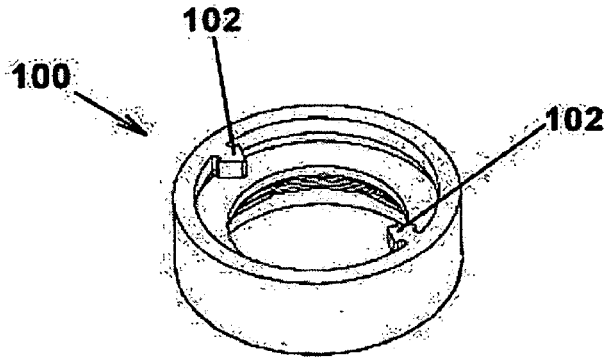
FIG. 10 is a perspective view of the front gasket of FIG. 9.
Figure 11:
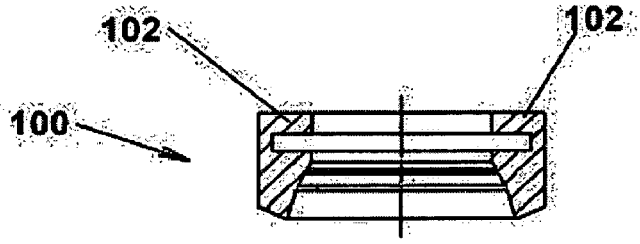
FIG. 11 is a cross sectional view of the front gasket of FIG. 9.
Figure 12:
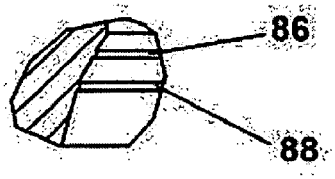
FIG. 12 is an enlarged cross sectional view of the sealing ribs on the front gasket of FIG. 9.

Referring to FIG. 8, the lamp unit 100 for use in the light assembly 10 as previously mentioned preferably corresponds to a PAM 38, 150 W light. The unit 100 is characterized by an outer glass reflector envelope 102 having a rearward portion including a curved reflector end section 104 and a base 106 terminating with a threaded conductive sleeve 108 and a base contact 110. The sleeve 106 is threaded into the socket 36 for establishing the electrical connection with the leads of the power cord in a well known manner. The curved end section 104 has a contour complementary with the front wall 84 of the gasket 24 with the sealing ribs 86, 88 establishing primary and secondary sealing interfaces between the gasket 24 and the lamp unit section 104 to prevent moisture intrusion in the space therebetween, and at the surfaces at the groove 94 establishing a sealing interface with the flange 72 to prevent moisture intrusion therebetween. The localized compressive engagement at the ribs is sufficient to maintain sealing contact during operation and the extremes of ambient temperatures. The limited contact area at the ribs is sufficient for sealing requirements while limiting engagement to a level permitting removal and replacement of the unit without undue or potentially damaging torque levels.

It will be appreciated from the foregoing that the sealing systems of the invention provide and maintain complete sealing of the housing cavity under the extremes of outdoor operation, both for surface mounting and ground mounting. The plural sealing interfaces of the light gasket with the light and the housing allows the housing to be inclined at the full range of motion at the pivot connection with any moisture or precipitation ingress prevented. Further the rear gasket 26 effectively seals the cord and the housing at other potential ingress sites. Thus the present invention may be oriented at desired by the user and not subject to the mounting and use limitations of prior units.

In another embodiment as shown in FIGS. 9 through 12, the front or bulb sealing gasket is provided with retention tabs for increasing the resistance to shifting or dislodging during installation and/or use. Therein, the front sealing gasket 120 includes a pair of diametrically opposed, radially inwardly projecting barbs 122 formed at the base 124 of the lower sleeve 126. The barbs 122 project through diametrically opposed circular openings 128 formed in the sleeve 70 of the housing. The barbs 122 have a thickness slightly smaller than the openings. The barbs 122 each include a triangular tip 130 and a rectangular shank 132 disposed in the opening in assembly. The tip 130 includes deflectable ends 134 adjacent the shank 132. The gasket 120 is positioned on the housing sleeve with the flange in the groove of the gasket, and the barbs 122 aligned with the openings 128. The barbs 122 are pressed inwardly, with the ends 134 deflecting through the openings and expanding thereafter thereby locking the gasket against axial or rotational movement while effecting sealing between the bulb and the housing as described above. The front end of the gasket 120 also includes the sealing ribs 86, 88.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claim.

What is claimed is:

1. A weatherproof outdoor pivoting lighting assembly for a lamp having a forwardly diverging glass envelope and a threaded electrical connection end, said lighting assembly comprising: a thin wall housing having a peripheral wall and a base wall providing an outwardly opening cavity, said peripheral wall frontally terminating with a transverse annular flange; a socket mounted in said cavity having electrical connection means for electrically and mechanically engaging said electrical connection end of said lamp with said envelope adjacent said flange of said housing; an opening in said base wall of said housing; a power cord including a first end for connection with a source of power and a second end extending through said opening in said base wall and electrically connected with said electrical connection means on said socket; a first gasket member formed of an elastomeric material, said first gasket member having an annular body, said first gasket member having an inner surface including a front interior surface conforming to said envelope and provided with a pair of axially spaced inwardly projecting narrow sealing ribs for locally compressively engaging said envelope to establish inner sealing interfaces therebetween, said inner surface having an outwardly extending annular groove for receiving said flange with the surfaces of said groove engaging said flange to establish an outer sealing interface therebetween, said inner surface further including a cylindrical section adjacent said groove and overlying an outer surface of said housing adjacent said flange, said outer surface of said housing including aperture means and said cylindrical section includes inwardly projecting means extending through said aperture means for axially and circumferentially retaining said front gasket on said housing; and bracket means including pivot means for mounting at a outdoor location and positioning said lamp unit at a desired inclination with respect thereto.

2. The weatherproof outdoor pivoting light assembly as recited in claim 1 wherein said bracket means includes a base for mounting on a planar substrate.

3. The weatherproof outdoor pivoting light assembly 1 wherein said bracket means includes a base having a tapered end for insertion into a ground area at said location.

4. The weatherproof outdoor pivoting light assembly as recited in claim 1 wherein said projecting means includes a shank section in said apertures means terminating with a enlarged tip having deflectable sections accommodating insertion through said aperture means and engaging an inner surface of said housing adjacent said aperture means for retaining said front gasket on said housing.

5. The weatherproof outdoor pivoting light assembly as recited in claim 4 wherein said tips have a triangular configuration.

6. The weatherproof outdoor pivoting light assembly as recited in claim 1 including a rear gasket for sealing between said base wall of said housing and said power cord, said rear gasket having an annular body formed on an elastomeric material including a cylindrical inner surface for slidably compressively receiving said power cord and establishing a cord sealing interface therewith, an outer surface having a front section insertable through said opening and a center section having an outwardly opening groove for receiving the surface of said base wall surrounding said opening and establishing a rear sealing interface with said housing.

7. The weatherproof outdoor pivoting light assembly as recited in claim 6 including an annular retaining member in said cavity and mechanically attached to said power cord for limiting rearward movement thereof.

8. The weatherproof outdoor pivoting light assembly as recited in claim 7 including mechanical fastener means for attaching said socket to said base of said housing and form limiting forward movement of said power cord and said socket.

9. A weatherproof outdoor pivoting lighting assembly for a lamp unit of a parabolic aluminized reflector type characterized by a front glass envelope having a curved rear section and a rear threaded electrical connection end extending from the rear curved section, said lighting assembly comprising: a thin wall housing, said housing having side and base walls forming an outwardly opening cavity and an annular flange at the front of said side wall; an electrical socket carried in said cavity for electrically and mechanically engaging the electrical connection end of the lamp unit with the envelope adjacent said flange of said housing; an opening in said base wall of said housing; a power cord including a first end for connection with a source of power and a second end extending through said opening in said base wall and electrically connected with said socket; an annular first gasket member formed of an elastomeric material, said first gasket member having an inner wall forming an axial opening, said inner wall having a frontal curved section complementary to the curved rear section of the glass envelope; at least one annular inwardly projecting narrow annular sealing surface formed on said frontal curved section for locally compressively engaging the curved rear section of the envelope to establish a first sealing interface therebetween; an inwardly opening annular groove formed in said inner wall rearwardly of said curved section for receiving and compressively engaging said flange to establish a second sealing interface; a second gasket member extending through said opening in said base wall, said second gasket member having an annular body formed of an elastomeric material, said annular body having a cylindrical inner surface compressively engaging said power cord to establish a cord sealing interface therewith, said annular body having an outer surface compressively engaging said base wall at said opening to establish a rear sealing interface with said housing; and bracket means including pivot means for mounting said housing at an outdoor location and positioning said lamp unit at a desired inclination with respect thereto.

10. The lighting assembly as recited in claim 9 wherein a pair of annular sealing surfaces are formed on said curved section of said first gasket member for establishing plural sealing interfaces with the curved rear section of the glass envelope.

* * * * *